US005743423A

United States Patent [19]

Franco

[11] Patent Number: 5,743,423

[45] Date of Patent: Apr. 28, 1998

[54] SNAP-ON PACKAGE

[76] Inventor: Richard E. Franco, 121 SW. 5th Ct., Pompano Beach, Fla. 33060

[21] Appl. No.: 815,474

[22] Filed: Mar. 11, 1997

[51] Int. Cl.[6] ..... B65D 6/00; B65D 21/02

[52] U.S. Cl. ..... 220/23.86; 220/23.6; 206/501; 206/509; 215/6; 215/10

[58] Field of Search ..... 220/23–86, 23.6; 215/10, 6; 206/821, 501, 509, 514

[56] References Cited

U.S. PATENT DOCUMENTS

| | | | |
|---|---|---|---|
| D. 291,181 | 8/1987 | Franco | D9/428 |
| 2,997,199 | 8/1961 | Reachl | 220/23.86 |
| 3,542,230 | 11/1970 | Campbell et al. | 215/10 |
| 3,927,782 | 12/1975 | Edwards | 215/10 |
| 4,513,875 | 4/1985 | Kuehn, Sr. | 215/10 |
| 4,708,253 | 11/1987 | Mednis | 220/23.6 |
| 5,064,101 | 11/1991 | Richter et al. | 215/10 |
| 5,318,787 | 6/1994 | Brauner et al. | 220/23.86 |

*Primary Examiner*—Joseph M. Moy
*Attorney, Agent, or Firm*—Oltman,Flynn & Kubler

[57] ABSTRACT

The package comprises a container made of resilient molded plastic that contains an impression and lid. The impression is located in the bottom of the container. The impression comprises two concentric cylindrically shaped tubes, a ring that connects the tubes and a closure. The lower tube has a larger diameter. This lower tube is attached to a ring along the ring's outside edge. The inner edge of the ring is attached to the upper, smaller-diameter tube. The tubes are identical to the diameters of two sizes of bottle caps. Bottles with caps can then be inserted into the tube. The invention then holds the container on top of the bottle. The lid of the container is removable and reattachable and forms an air-tight seal.

4 Claims, 2 Drawing Sheets

SNAP-ON PACKAGE

BACKGROUND OF THE INVENTION

1. Field of the Invention

This invention pertains to a snap-on package. In particular, a package that can be snapped onto the top of a bottle 2. Description of the Related Art Including Information Disclosed Under 37 CFR 1.97 and 1.98

This invention is similar to the package described in U.S. Pat. No. Des. 291,181. However, this invention is improved as it contains a connector that allows the bottom of the container to snap onto the cap of a bottle.

SUMMARY OF THE INVENTION

This invention pertains to a snap-on package. The package comprises a container with an indentation in its bottom. The shape of this indentation is designed to match the shape of a bottle's cap. The package can then be placed on top of a bottle where the bottle snaps into place. Once snapped into place, the package is held firmly in place atop the bottle. In addition, the package can be removed from the bottle by pulling it longitudinally away from the bottle.

The preferred embodiment of the invention is a snap-on package. The package comprises a container made of resilient molded plastic that contains an impression and lid. The impression is located in the bottom of the container. The impression comprises two concentric cylindrically shaped tubes, a ring that connects the tubes and a closure. The lower tube has a larger diameter. This lower tube is attached to a ring along the ring's outside edge. The inner edge of the ring is attached to the upper, smaller-diameter tube. The tubes are identical to the diameters of two sizes of bottle caps. Bottles with caps can then be inserted into the tube. The invention then holds the container on top of the bottle. The lid of the container is removable and reattachable and forms an air-tight seal.

An additional quality of the invention is that the indentation can have a series of coaxial tubes with different-sized diameters. The diameters of of the tubes decrease toward the interior of the indentation. Each tube is attached to the adjacent tube by a ring where the larger-outside tube connects to the outer edge of the ring and the smaller inside tube connects to the inner edge of the ring. The decreasingly-sized tubes allow the container to accommodate a variety of different size bottle caps. This means that one container containing several size tubes can be manufactured allowing the container to be usable with several different size bottle caps.

In addition, the container may include a lid. The lid can be used to seal the contents of the container. Furthermore, this lid can be fashioned to form an air-tight seal so as to protect the container's content.

This invention presents several advantages over the prior art: attractive and minimal packaging, decreased storage space, and improved organization.

The invention provides an attractive method to ship and market an additional container along with a bottle in one convenient package. For example, a manufacturer can use the invention to include additional ingredients along with a bottled ingredient in one package. The advantage is that a combined product immediately suggests to the consumer the manufacturer's additional ingredients and it suggests ways that the original bottle ingredient may be used. More specifically, an example of the invention would be to package a bottle of liquor with the invention snapped on to the bottle's cap where the snap-on package contains an additional mixing agent. For example, a bottle of tequila with a snap-on container of salt is a convenient method for storing the ingredients for a Margarita. Continuing the tequila-salt example, the advantage of using the invention is that it allows the manufacturer to market tequila and salt in one package. Furthermore, consumers using the invention are immediately suggested of a method of using the contained goods—placing some of the salt in the lid and placing the wetted rim of a glass in the salt so that upon drinking a Margarita from the glass it will taste salty.

Another improvement over the prior art that the invention provides is it decreases storage space. The invention allows items to be placed in the invention. The invention can then be snapped onto a bottle cap and be stored. The advantage gained is that by stacking the container and the bottle the area of ground space required by the bottles and containers is minimized because the invention-container and the bottle no longer have to be stored next to each other. This advantage is significant in situations where ring space is limited. Such limited space can be encountered on the shelves in stores or in crowded bar shelves.

An additional improvement embodied in the invention is that the invention provides a way to store items with an associated bottle. For example, mixers could be stored with a liquor, seasoning could be kept with salad dressing, pills could be kept with a water bottle, water purification tablets could be kept with a canteen, or soap powder snapped onto a bottle of liquid bleach. In all of these cases, the additional items could be placed in a container utilizing the invention and then snapped onto an appropriate bottle.

DESCRIPTION OF THE PREFERRED EMBODIMENT

Figure 1:
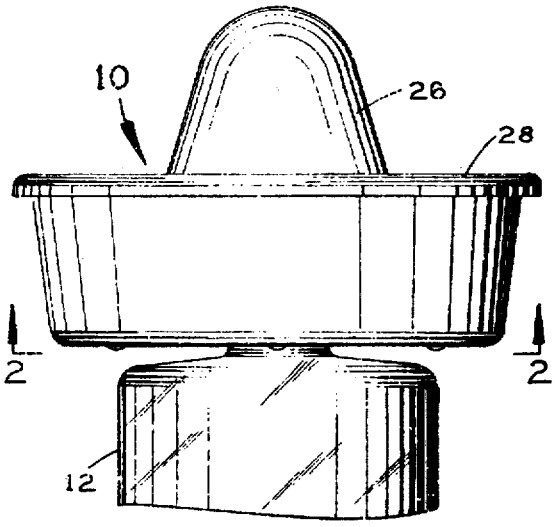
FIG. 1 is a front elevational view of one embodiment showing a container snapped onto a bottle.

FIG. 1 depicts a side view of a container 10 with the invention that has been snapped into place onto a bottle 12 and its cap 13.

Figure 2:
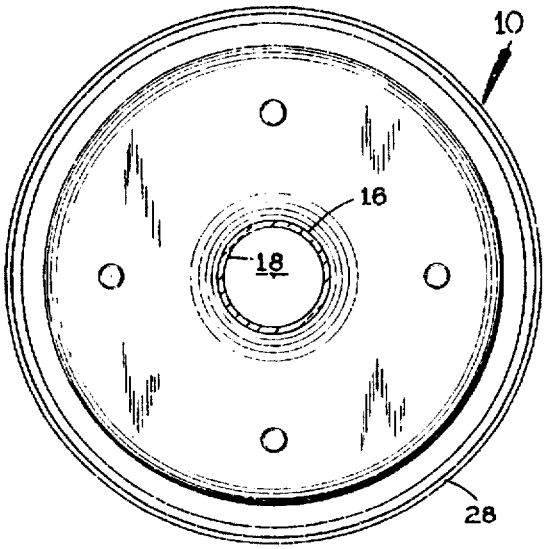
FIG. 2 is a bottom plan view taken along line 2—2 of FIG. 1.

FIG. 2 depicts a bottom view of a container 10 with the invention. The concentric circles 16 and 18 in the middle depict the impression that is comprised of concentric tubes connected by rings where the diameter decreases. Each tube is designed to snap onto a bottle cap of a similar diameter.

Figure 3:
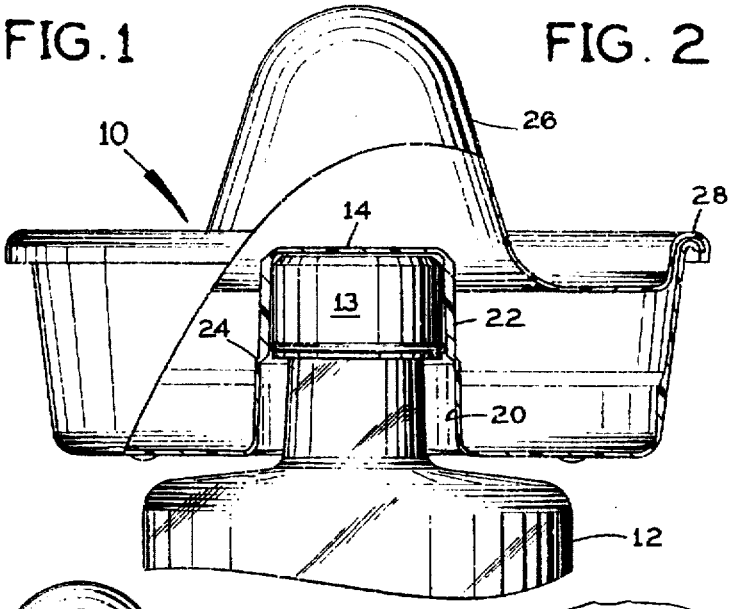
FIG. 3 is a cut-away view similar to FIG. 1.

FIG. 3 depicts a side cut-away view of a container 10 utilizing the invention that is snapped onto a bottle cap 13. Furthermore, FIG. 3 depicts the container having two tubes—a lower, larger-diameter tube 20 and an upper, small-diameter tube 22—in which a bottle cap is snapped into place. Furthermore, the upper,smaller tube and the larger, lower tube are connected by a ring 24 where the diameter decreases. At the top of the impression is a closure 14 that closes the end of the innermost tube 22. This figure also depicts a snap-on package with a lid 26. A bottle cap 13 is inside the upper tube 22.

Figure 4:
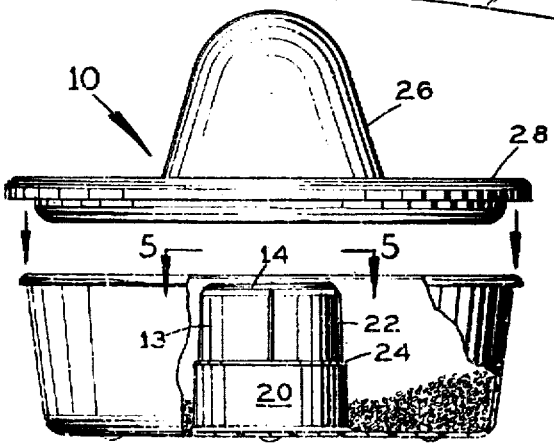
FIG. 4 is an exploded view, partially cut away, showing the interior of the container.

FIG. 4 depicts a side cut-away view of the invention. This view shows the shape of the invention in the interior of a container 10. The upper, smaller-diameter tube 22, a ring 24 where the diameters of the concentric tubes decrease and the lower, larger-diameter tube 20 are depicted in this figure. At the top of the upper, small-diameter tube 22 is a closure 14 that closes the top of the tube. Finally, a lid 26 is shown separated from the container 10. This lid is held in place on the container by a rim 28. The bottle cap 13 is shown inside the upper tube 22.

Figure 5:
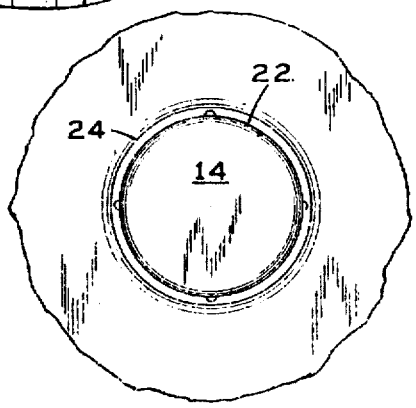
FIG. 5 is a fragmentary plan view taken along line 5—5 of FIG. 4.

FIG. 5 depicts a top view of a container that has the invention located in the container's bottom. In this view, the lid is removed. The upper, smaller-diameter tube 22 is shown and the closure 24 is visible.

Figure 6:
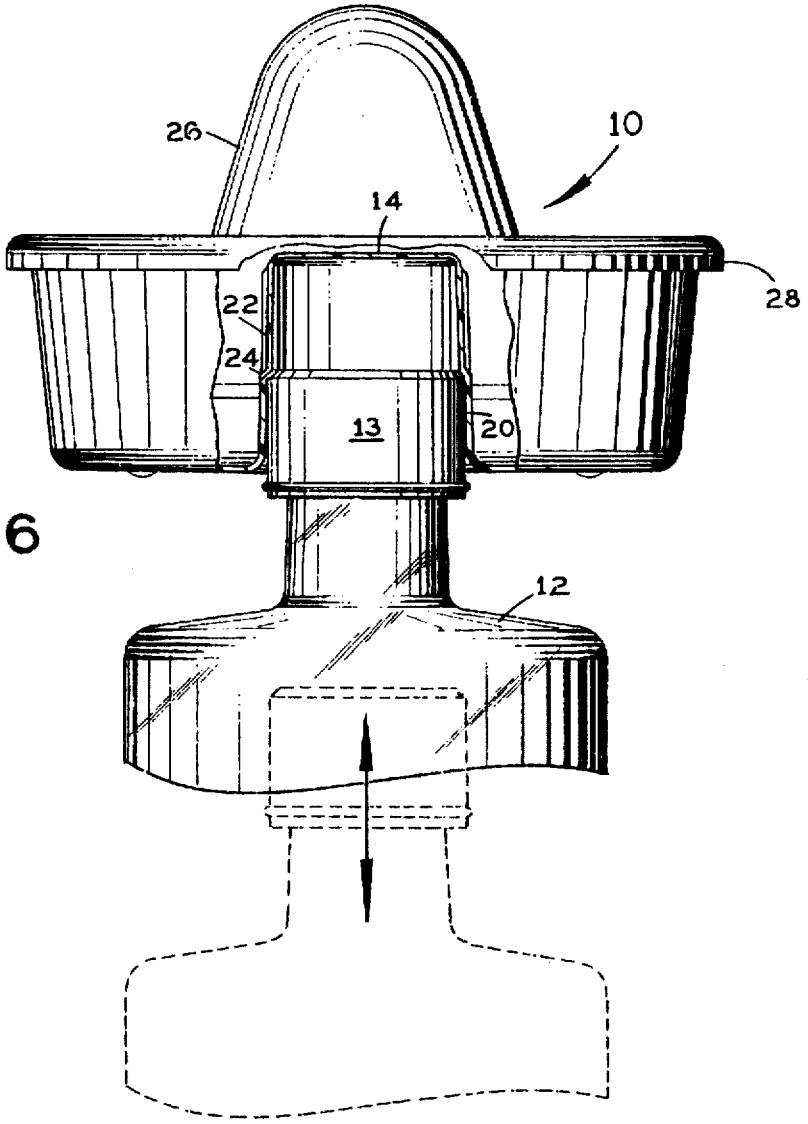
FIG. 6 is a cut-away view similar to FIG. 3, but showing the bottle cap snapped onto a larger tube.

FIG. 6 depicts a container 10 utilizing the invention within its bottom that has a bottle 12 snapped into the larger-diameter lower tube 20. Here the bottle cap 13 is abutted against the ring 24. A side view of the closure 14 of the impression is also visible.

Figure 7:
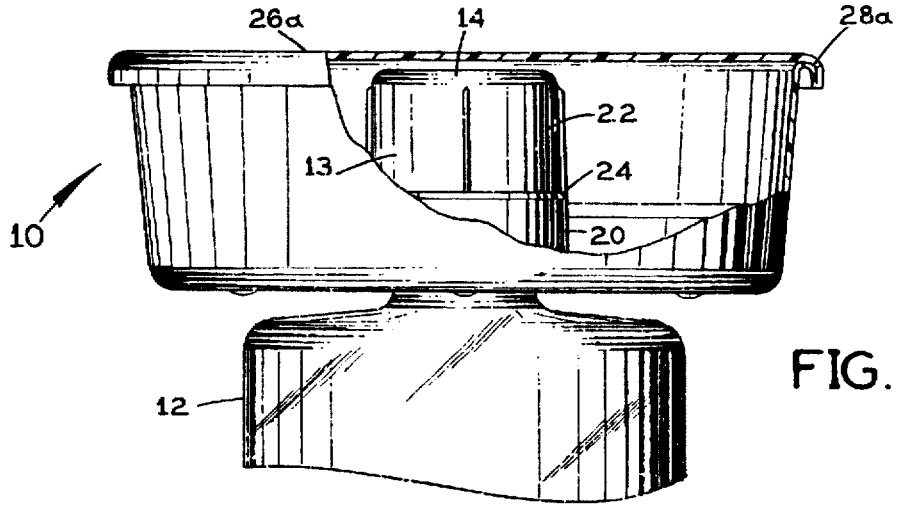
FIG. 7 is a cut-away view of a container having a flat lid.

FIG. 7 depicts the container 10 snapped onto a bottle 12 and its cap 13 and the interior side of the impression comprising an upper smaller-diameter tube 22, a ring 24, where the impression's diameter changes, and the lower, larger-diameter tube 20. The closure 14 to the upper, smaller-diameter tube is also depicted. Note that the lid 26*a* is flat in this embodiment and the lip 28*a* is slightly different. The tubes 20 and 22 may have a slight taper.

I claim:

1. A snap-on package comprising:

A. a container;

B. an impression within said container comprising:

1) a series of tubes, a) wherein said tubes are concentric and have different diameters, b) wherein said tubes are substantially cylindrically shaped, c) wherein said tubes are adjacent to each other, d) wherein said tubes are located so that the tube with the largest diameter is located outermost in the impression and the smallest diameter tube is located innermost in the impression, wherein the uppermost of said tubes has its top closed by a closure;

2) a ring, a) wherein said ring is located between said adjacent tubes, b) wherein said ring has an outer edge with an outside diameter equal to that of the larger adjacent tube, wherein said outer edge is connected to the edge of the larger, adjacent tube, c) wherein said ring has an inside edge with an inside diameter equal to that of the smaller adjacent tube, wherein said outer edge is connected to the edge of the smaller adjacent tube (3) a closure, a) wherein said closure is attached to edge of the smallest tube.

2. A snap-on container described in claim 1, wherein said container has a removable lid.

3. A snap-on container described in claim 2, wherein said lid forms an airtight seal.

4. A snap-on package comprising:

A. a container,

B. an impression within said container wherein said impression comprises:

1) two tubes having different diameters, a) wherein said tubes are concentric, b) wherein said tubes are cylindrically shaped, c) wherein said tubes are located adjacent to one another, d) wherein said tubes are located so that the tube with the larger diameter is located outermost in the impression and the smaller diameter tube is located innermost in the impression;

2) a ring, a) wherein said ring has an outer diameter equal to that of the lower, larger-diameter tube, b) wherein said ring has an inside diameter equal to that of the upper, smaller-diameter tube, c) wherein said ring's outer edge is connected to the edge of the larger-diameter tube, and d) wherein said ring's inner edge is connected to the edge of the smaller-diamter tube, 3) a closure, a) wherein said closure is attached to the edge of the smaller tube on the edge that is not adjacent to the larger tube so that said closure closes the end of the tube, C) a removable lid wherein said lid forms an airtight seal.

* * * * *